US005595075A

United States Patent [19]

Chen

[11] Patent Number: 5,595,075

[45] Date of Patent: Jan. 21, 1997

[54] LOCK AND ALARM MEANS LOCKABLE ON WINDOW AND DOOR RAIL

[76] Inventor: Mike Chen, c/o Hung Hsing Patent Service Center P.O. Box 55-1670, Taipei, Taiwan

[21] Appl. No.: 381,345

[22] Filed: Jan. 31, 1995

[51] Int. Cl.[6] ..... E05B 65/08

[52] U.S. Cl. ..... 70/95; 70/90; 70/DIG. 49; 292/288; 292/DIG. 46; 340/545

[58] Field of Search ..... 70/19, DIG. 49, 70/89, 90, 95, 14, 96, 97, 99; 292/258, 288, DIG. 46; 340/545, 546

[56] References Cited

U.S. PATENT DOCUMENTS

| | | | |
|---|---|---|---|
| 1,196,445 | 8/1916 | Ellis | 292/288 |
| 3,428,349 | 2/1969 | Shelton | 292/288 |
| 3,490,802 | 1/1970 | Zeit | 292/288 |
| 4,059,299 | 11/1977 | Huntley | 70/14 X |
| 4,059,832 | 11/1977 | Conklin | 340/546 |
| 4,438,428 | 3/1984 | Ober et al. | 340/546 X |
| 4,663,949 | 5/1987 | Yane | 292/DIG. 46 X |
| 4,837,557 | 6/1989 | Striebel | 340/546 |
| 5,234,239 | 8/1993 | Allenbaugh | 292/DIG. 46 X |
| 5,299,437 | 4/1994 | Paugh | 292/288 X |

FOREIGN PATENT DOCUMENTS

| | | | |
|---|---|---|---|
| 0384141 | 8/1990 | European Pat. Off. | 292/DIG. 46 |
| 2211008 | 6/1989 | United Kingdom | 340/545 |

*Primary Examiner*—Lloyd A. Gall

[57] ABSTRACT

A lock and alarm device includes: a lock body held on a window and door rail at a lower position of the door or window for an easier concealment, a vise having two jaw members telescopically mounted in a bottom of the lock body to be firmly tensioned or retained on the rail as driven by a knob for retarding a sliding opening of the window and door, and an alarm mounted on the lock body and operatively actuated for sensitively detecting an unexpected opening of the window and door for enhancing security when the opening of the window or door triggers a touch-on switch of an alarm circuit, or when the vibrations caused by the opening of the window or door actuates a vibration sensor of the alarm circuit.

1 Claim, 5 Drawing Sheets

LOCK AND ALARM MEANS LOCKABLE ON WINDOW AND DOOR RAIL

BACKGROUND OF THE INVENTION

A conventional window lock as shown in FIG. 7 includes: a semicircular disk pivotally secured on a first window leaf W having a handle H and an extending rim R engageable with a hook H1 formed on a second window leaf W1 for locking the pair of window leaves W, W1 when closed to each other. Since the conventional window lock can be easily discovered by an intruder or thief outside the window, he may then cut out a small opening C on the window W or W1 for easily unlocking the conventional window lock.

SUMMARY OF THE INVENTION

The object of the present invention is to provide a lock and alarm device including: a lock body held on a window and door rail at a lower position of the door or window for an easier concealment, a vise having two jaw members telescopically mounted in a bottom of the lock body to be firmly tensioned or retained on the rail as driven by a knob for retarding a sliding opening of the window and door, and an alarm mounted on the lock body and operatively actuated for sensitively detecting an unexpected opening of the window and door for enhancing security when the opening of the window or door triggers a touch-on switch of an alarm circuit, or when the vibrations caused by the opening of the window or door actuates a vibration sensor of the alarm circuit.

DETAILED DESCRIPTION

Figure 1:
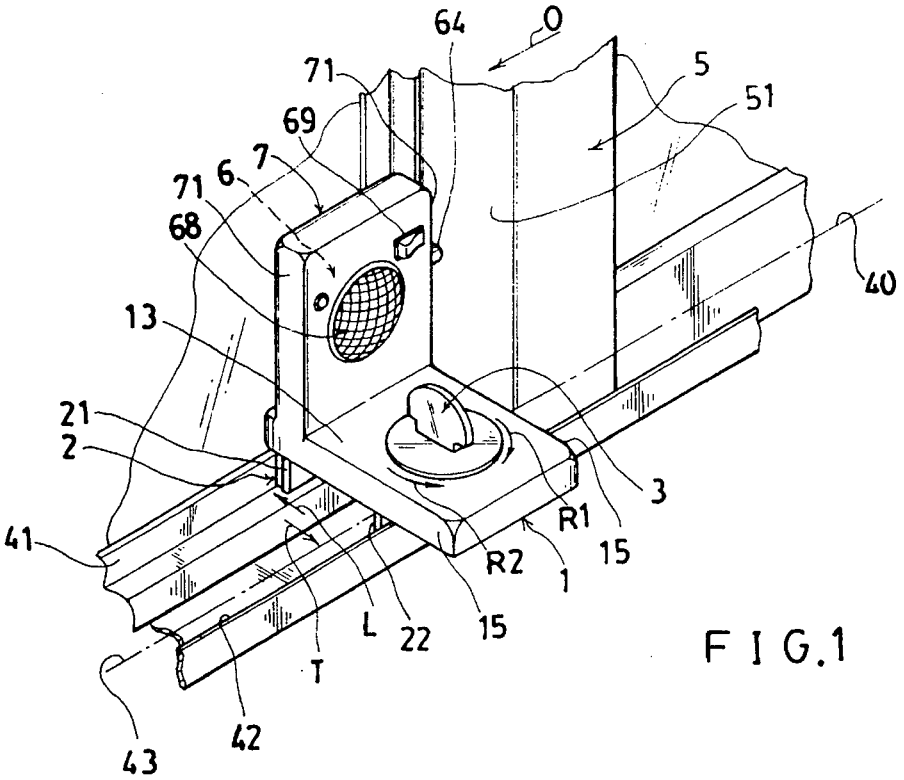
FIG. 1 is an illustration showing a window lock application of the present invention.
Figure 2:
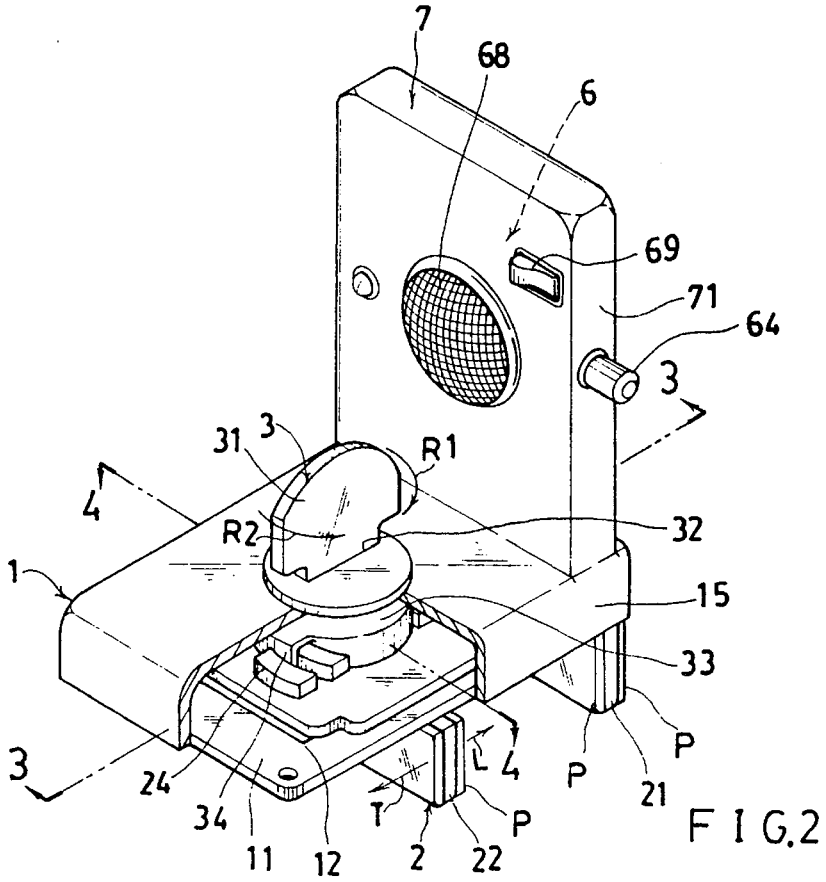
FIG. 2 is a partial cut-away illustration of the present invention.
Figure 4:
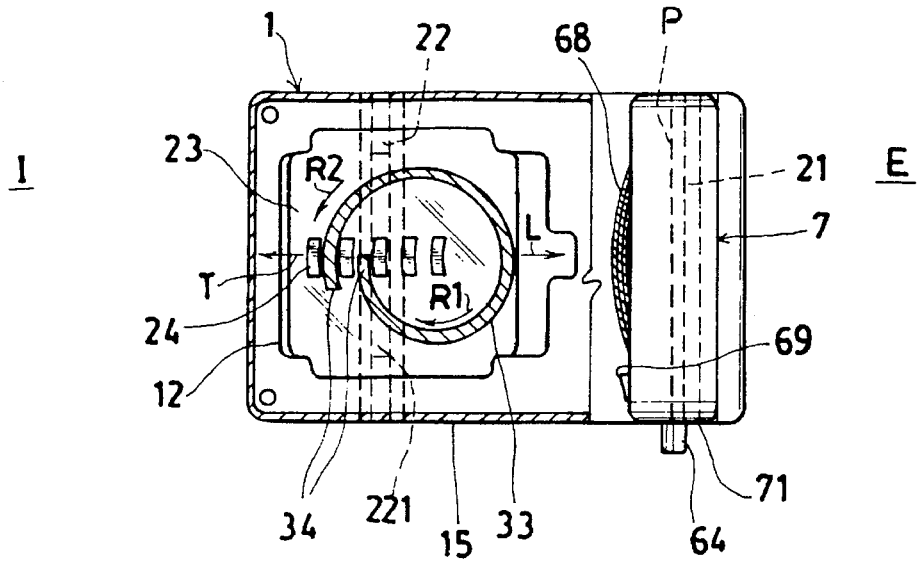
FIG. 4 is a partial sectional drawing of the present invention when viewed from 4—4 direction of FIG. 2.
Figure 3:
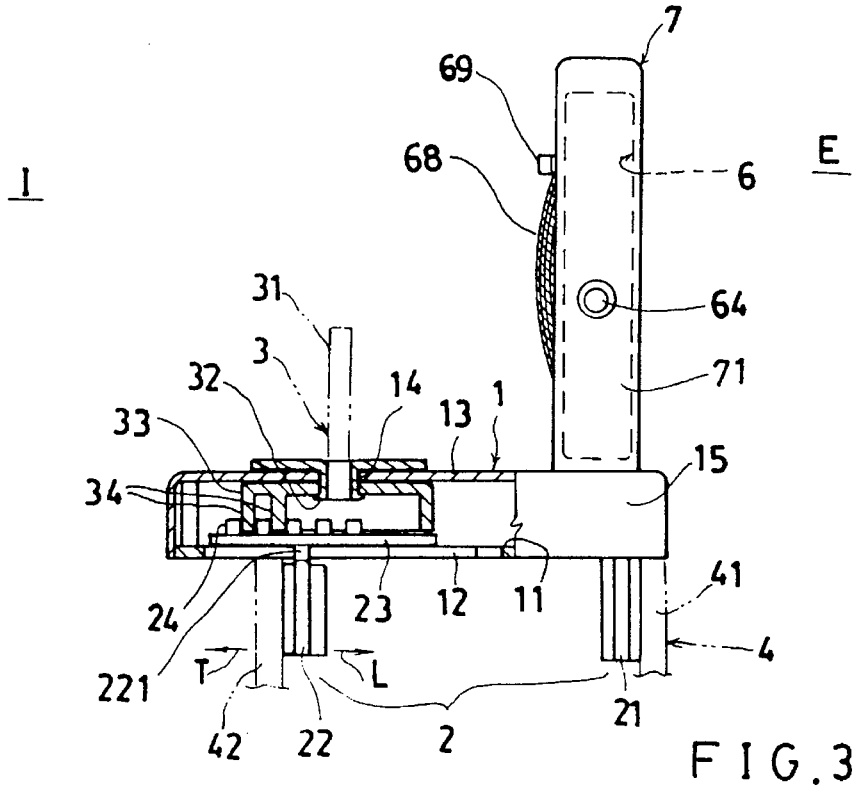
FIG. 3 is a partial sectional drawing of the present invention when viewed from 3—3 direction of FIG. 2.
Figure 5:
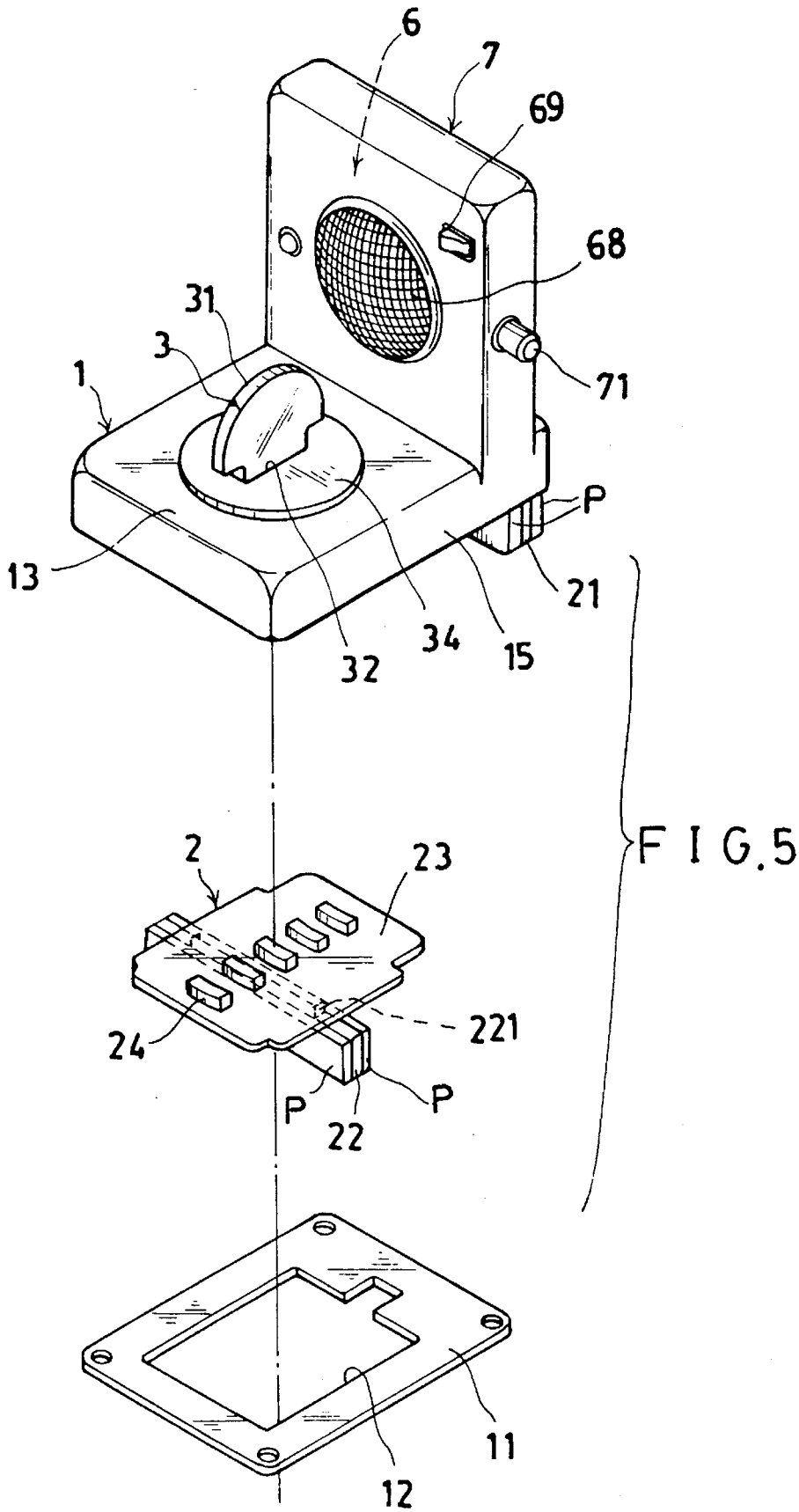
FIG. 5 is an exploded view showing the elements in construction of the present invention.

As shown in FIGS. 1–6, the present invention comprises: a lock body 1, a vise means 2, a driving means 3, and an alarm means 6 mounted in an alarm casing 7.

The lock body 1 includes: a bottom 11 having a sliding slot 12 longitudinally formed in the bottom 11, an upper portion 13 having a shaft hole 14 formed in a central portion of the upper portion 13, and at least a side wall 15 facing a side frame 51 of a window and door 5.

The vise means 2 includes: a fixed jaw member 21 protruding downwardly from a rear portion of the lock body 1 to be contacted with a first rail wall 41 of a window and door rail means 4 adjacent to an exterior E of the window and door 5, a movable jaw member 22 protruding downwardly from a sliding plate 23 slidably reciprocatively held in the lock body 1 to be extendibly retained on a second rail wall 42 of the rail means 4 adjacent to an interior I and opposite to the fixed jaw member 21, and a plurality of rack teeth 24 equally spaced and longitudinally formed on an upper surface of the sliding plate 23, with each rack tooth 24 generally arcuate shaped and the movable jaw member 22 having a neck portion 221 formed under a bottom surface of the sliding plate 23 to be slidably engaged with the sliding slot 12 notched in the bottom 11 of the lock body 1. Each jaw member 21 or 22 may be coated with packing members P on its inner or outer surface for enhancing its friction with the rail means 4.

The lock body 1 has one side wall 15 besides a front wall 16 of the lock body 1 for facing the side frame 51 of the window and door 5 for retarding an opening (O) of the window and door 5 slidably moved within the first and second rail walls 41, 42 along a guiding rail 43 positioned in between the first and the second rail walls 41, 42 of the rail means 4 along a rail axis 40.

The driving means 3 includes: a knob 31 secured to a shaft 32 rotatably engageable with the shaft hole 14 formed in the upper portion 13 of the lock body 1 and protruding upwardly from the upper portion 13 of the lock body 1, a driving disk 33 secured to the shaft 32 and positioned below the upper portion 13 of the lock body 1, and a spiral thread 34 spirally formed on a bottom surface of the driving disk 33 to be tangentially engageable with the rack teeth 24 formed on the sliding plate 23 of the movable jaw member 22, whereby upon rotation of the knob 31 of the driving means 3, either clockwise R1 or counterclockwise R2, the sliding plate 23 of the movable jaw member 22 will be driven inwardly T towards the interior I of the window and door 5 to be retained on the second rail wall 42 of the rail means 4 for firmly retaining the lock body in the rail means 4 for locking the window and door 5, or outwardly L towards the exterior E of the window and door 5 to be loosened from the second rail wall 42 of the rail means 4 for a removal of the lock body 1 from the rail means 4. The reciprocative movements (T, L) of the movable jaw member 22 in relation to the fixed jaw member 21 are oriented in a direction generally perpendicular to the rail axis 40.

The lock body 1, the vise means 2 and the driving means 3 may be combined to be a lock set to be used for locking a window or door 5 independently.

Or, the alarm means 6 stored in the alarm casing 7 may be mounted on or integrally secured with the lock body 1 as shown in the drawing figures.

The alarm means 6 is mounted in the alarm casing 7 and the casing 7 is protruded upwardly from a rear upper portion of the lock body 1 to have a side casing wall 71 coplanar to the side wall 15 of the lock body 1 for facing the side frame 51 of the window and door 5.

The alarm means 6 includes: an integrated circuit 61 for receiving an input signal from a trigger pin 611 of the integrated circuit 61 and for transmitting an alarming signal from an output pin 612 of the integrated circuit 61, a power source 62 which may be a battery or a plurality of batteries stored in the casing 7 for powering the alarm means 6, a vibration sensor 63 which is electrically connected to the integrated circuit 61 through the trigger pin 611, and may be a spring switch or other sensors capable of producing a voltage signal, when the lock body 1 is vibrated as impacted by the side frame 51 of the window and door 5 as intentionally opened by an intruder or thief, to be input to the integrated circuit 61 for executing an alarming operation in the integrated circuit 61 for actuating an alarm 68 which may be an alarming buzzer electrically connected to the integrated circuit 61 through an alarm driver 67 which may include a transistor Q1 and a transformer T for amplifying the current and voltage for producing audible alarm sounding from the alarm 68, a touch-on switch 64 electrically connected to the integrated circuit 61 through the trigger pin 611 and protruding sidewards from the side casing wall 71 of the alarm casing 7 to be actuated as impacted by the side frame 51 of the window and door 5 when opened by an intruder or thief, and an on-off switch 69 formed on the alarm casing 7 for an on and off control of the power source 62 of the alarm means 6.

Figure 6:
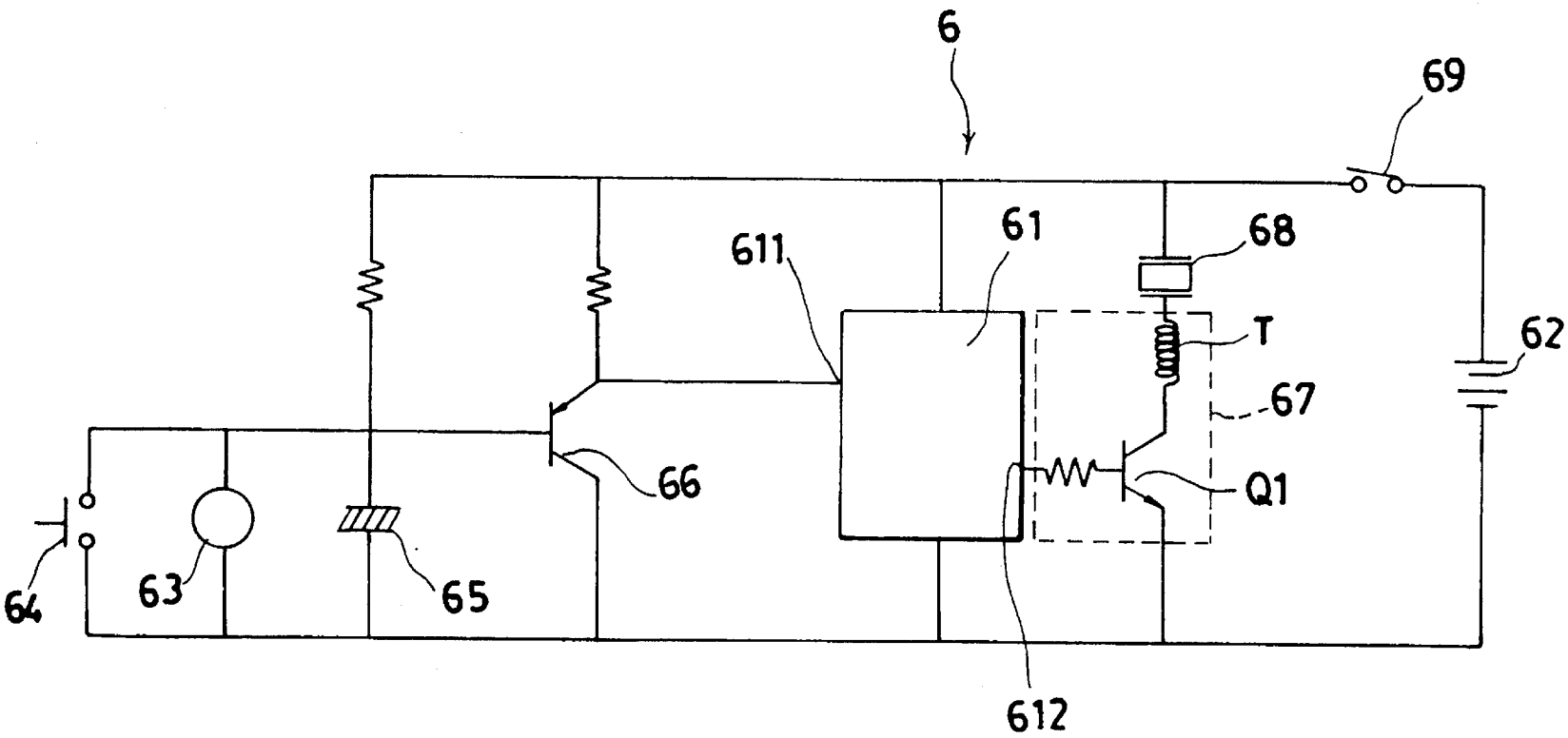
FIG. 6 is a circuit diagram of an alarm means of the present invention.
Figure 7:
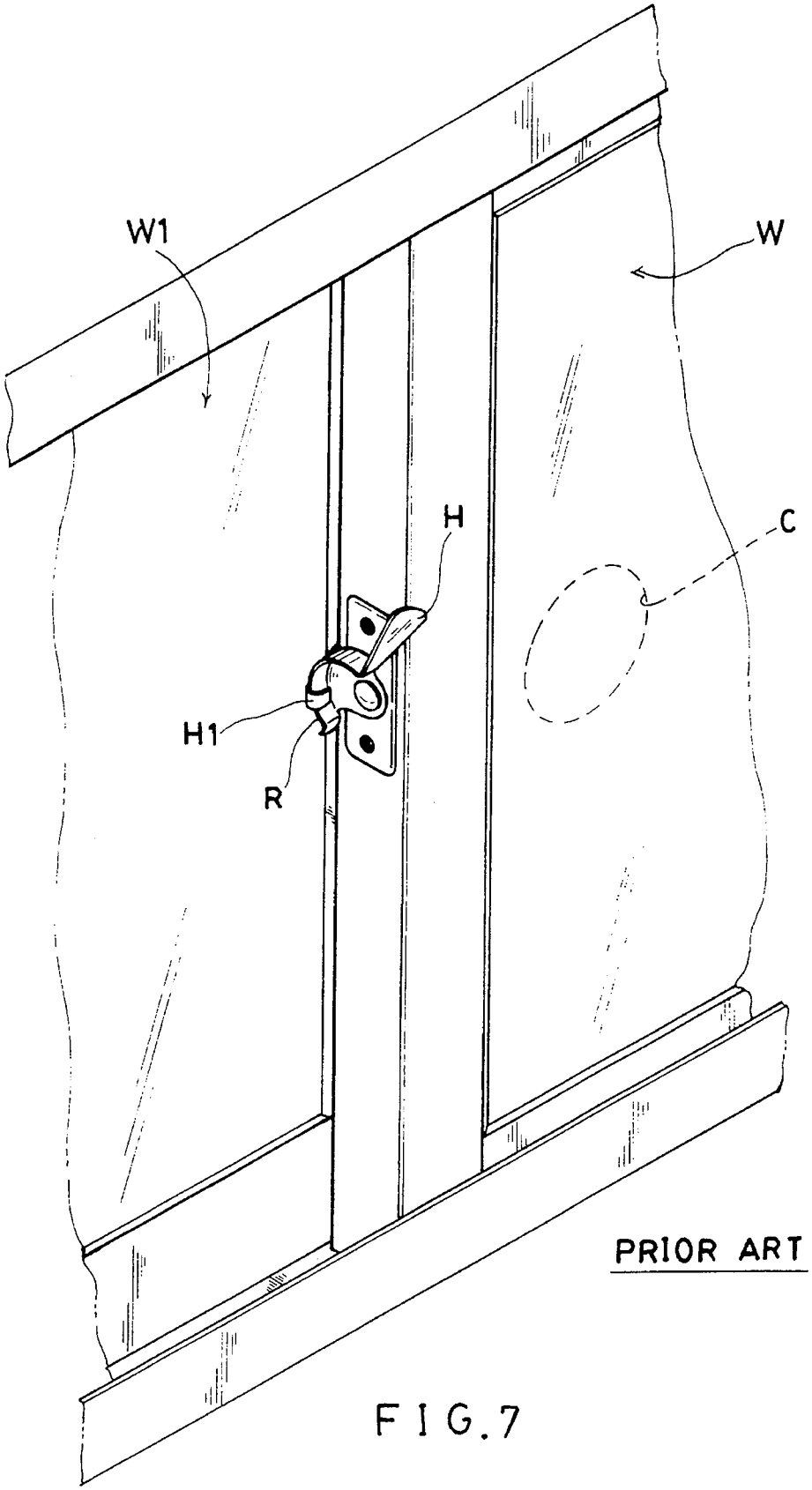
FIG. 7 is an illustration showing a conventional window lock.

As shown in FIG. 6, the vibration sensor 63 and the touch-on switch 64 are connected in parallel to the integrated circuit 61 through a capacitor 65 and a switching transistor 66 respectively connected between two poles of the power source 62. However, the sensor 63 or touch-on switch 64 may be directly connected to the integrated circuit 61, not limited in this invention.

When the on-off switch 69 is turned on to allow the power source 62 to charge the capacitor 65, a positive voltage potential will be built at a base of the switching transistor 66 of which the emitter is connected to the integrated circuit 61 and the collector is grounded. An intruder opens the window or door 5 to actuate either the sensor 63 or the touch-on switch 64 to close two poles of each sensor 63 or the switch 64 to ground the positive potential at the base of the transistor 66, thereby converting the "high" potential of transistor base to be "low" potential to conduct the transistor 66 to input the sensed signal into the integrated circuit 61 for sounding the alarm 68. The capacitor 65 will serve as a time delay of the alarm means 6 of the present invention.

Other modifications may be made for modifying the alarm circuit of the alarm means 6 and other structures or elements of the present invention, not limited. The alarm casing 7 may also be integrally formed into the lock body 1 to be a compact unit having the switch 64 facing the side frame 51 of the window and door 5.

The present invention may be changed or modified without departing from the spirit and scope as claimed hereinafter.

Even though a window or door is partially opened such as for ventilation purpose, the lock and alarm means of the present invention once being locked on the rail means, a further opening movement such as intentionally operated by a thief or intruder may still cause the alarm sounding of the alarm means 6 for alerting any person living in a room or house; and the lock body with the jaw members 21, 22 locked on the rail means 4 will also retard a further opening of the door or window, thereby efficiently enhancing security and safety mechanically and electronically.

I claim:

1. A lock and alarm means lockable on a window or door rail comprising:

a lock body having at least a side wall formed on a side portion of said lock body;

a vise means having two jaw members telescopically mounted on a bottom of said lock body to be movably held in a rail means of a window or door slidably held on the rail means along a rail axis of said rail means;

a driving means rotatably mounted on the lock body and operatively driving one of said two jaw members of said vise means for tightly retaining said two jaw members in said rail means to allow said side wall of said lock body to retard a side frame of the window or door for locking said window or door for preventing a sliding opening on said rail means; and an alarm means mounted on said lock body for actuating an alarm sounding when said alarm means and said lock body are impacted by said window or door when intentionally opened by an intruder;

the improvement which comprises:

said lock body including: a bottom having a sliding slot longitudinally formed in the bottom, an upper portion having a shaft hole formed in a central portion of the upper portion;

said vise means including: a fixed jaw member protruding downwardly from a rear portion of the lock body to be contacted with a first rail wall of said rail means adjacent to an exterior of the window or door, a movable jaw member protruding downwardly from a sliding plate slidably reciprocatively held in the lock body to be extendibly retained on a second rail wall of the rail means adjacent to an interior and opposite to the fixed jaw member, and a plurality of rack teeth equally spaced and longitudinally formed on an upper surface of the sliding plate, with the movable jaw member having a neck portion formed under a bottom surface of the sliding plate to be slidably engaged with the sliding slot formed in the bottom of the lock body; and said driving means operatively driving said movable jaw member in relation to said fixed jaw member to be locked in said rail means, said driving means including: a knob secured to a shaft rotatably engageable with the shaft hole formed in the upper portion of the lock body and protruding upwardly from the upper portion of the lock body, a driving disk secured to the shaft and positioned below the upper portion of the lock body, and a spiral thread spirally formed on a bottom surface of the driving disk to be engageable with the rack teeth formed on the sliding plate of the movable jaw member, whereby upon rotation of the knob of the driving means, the sliding plate of the movable jaw member will be driven in a direction generally perpendicular to said rail axis of said rail means for firmly retaining the jaw members in said rail means.

* * * * *